United States Patent [19]

Tanaka et al.

[11] Patent Number: 4,616,466

[45] Date of Patent: Oct. 14, 1986

[54] CAPPING APPARATUS

[75] Inventors: Hideo Tanaka; Shiaru Muranaka, both of Kanazawa, Japan

[73] Assignee: Shibuya Kogyo Co., Ltd., Japan

[21] Appl. No.: 670,429

[22] Filed: Nov. 8, 1984

[30] Foreign Application Priority Data

Nov. 15, 1983 [JP] Japan ..... 58-214428

[51] Int. Cl.[4] ..... B67B 3/20; B65B 7/28

[52] U.S. Cl. ..... 53/75; 53/317; 53/331.5

[58] Field of Search ..... 53/75, 76, 317, 306, 53/331, 331.5; 173/12; 279/1 R, 111

[56] References Cited

U.S. PATENT DOCUMENTS

| | | | |
|---|---|---|---|
| 3,031,822 | 5/1962 | Dimond | 53/317 |
| 3,303,633 | 2/1967 | Wilhere | 53/306 |
| 3,393,754 | 7/1968 | Hackemeister | 53/331.5 X |
| 3,405,499 | 10/1968 | Dexter | 53/317 X |
| 3,491,516 | 1/1970 | Bergeron | 53/331.5 X |
| 3,913,301 | 10/1975 | Keller et al. | 53/331.5 |
| 3,955,341 | 5/1976 | Wilhere | 53/331.5 |
| 4,273,198 | 6/1981 | Doniwa | 173/12 X |

*Primary Examiner*—Horace M. Culver

*Attorney, Agent, or Firm*—Alan H. MacPherson; Steven F. Caserza; Kenneth E. Leeds

[57] ABSTRACT

A capping apparatus includes a turn table which is supported to be rotatable and provided with a plurality of container holders for temporarily holding the containers securely, a plurality of cap holders for releasably holding caps to be screwed onto the mouth portion of the containers, a plurality of torque motors individually provided for rotating the corresponding cap holders and a microcomputer for controlling the level of torque applied to the cap holders by the torque motors. The torque applied to the cap holder during the screwing operation is set to be higher in level during the first revolution of the cap and lower in level during the remaining rotation of the cap than the torque applied upon completion of the screwing operation so that the caps can be screwed onto the threaded mouth portions of the containers all at the same tightening level.

3 Claims, 4 Drawing Figures

CAPPING APPARATUS

BACKGROUND OF THE INVENTION

1. Field of the Invention

This invention relates to a capping apparatus for capping containers, such as bottles, and, in particular, to a constant-torque capping apparatus capable of capping a container at a predetermined tightening torque accurately at all times. This invention is related to U.S. Pat. No. 4,535,583 issued Aug. 20, 1985, entitled "Rotary Type Capping Apparatus".

2. Description of the Prior Art

Typically, a prior art capping apparatus includes a turn table having a plurality of container holders disposed along the periphery of the turn table and a plurality of capping heads which are each provided corresponding in position to the container holders and driven to move along a circular path together with the turn table. Each of the capping heads has a cap holder which releasably holds a cap at its bottom and which is driven to rotate so as to have the cap screwed onto the mouth of the container held by the corresponding container holder on the turn table. In such a prior art capping apparatus, a sun gear is commonly provided as fixed in position and coaxial with a rotary shaft of the turn table and a plurality of pinions are provided in mesh with and disposed around the sun gear. Each of the pinions is fixedly provided on a driving shaft which is operatively connected to the corresponding cap holder so that the cap holder may be driven to rotate when the corresponding pinion moves around the sun gear in mesh therewith, thereby causing the cap held by the cap holder to be screwed onto the mouth of the corresponding container. In this prior art structure, a clutch is typically provided in a power transmitting system between the pinion and the cap holder and a slippage is induced in the clutch when the cap tightening force has reached a predetermined value.

However, in such a prior art capping apparatus, since the rotation of each pinion around its own axis depends on the rotation of the turn table, a torque for screwing a cap onto a container is directly determined by the rotation of the turn table. As a result, if the rotation of the turn table varies for some reason, the screwing or tightening torque also varies accordingly. This has been found to be extremely disadvantageous because the rotational speed of the turn table is sometimes desired to be set at different levels to accomodate other processing stations in the same container handling line, such as a filling station where desired contents are filled in the containers and a labelling station where labels are glued onto the containers. Moreover, even if the capping apparatus itself is operated at constant speed, the magnitude of inertia torque applied to the cap at the final stage of the capping operation tends to fluctuate for various reasons so that there has been encountered a difficulty in maintaining the cap tightening torque at a constant value with high accuracy.

SUMMARY OF THE INVENTION

It is therefore a primary object of the present invention to obviate the above-described disadvantages of the prior art and to provide an improved capping apparatus.

Another object of the present invention is to provide an improved capping apparatus capable of capping containers, such as bottles, at predetermined tightening torque at high accuracy at all times.

A still further object of the present invention is to provide an improved capping apparatus for having caps tightly screwed onto the mouth of containers at constant tightening torque one after another in a continuous manner.

Other objects, advantages and novel features of the present invention will become apparent from the following detailed description of the invention when considered in conjunction with the accompanying drawings.

DESCRIPTION OF THE PREFERRED EMBODIMENTS

Figure 1:
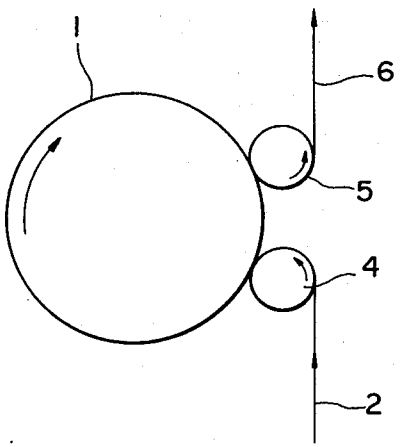
FIG. 1 is a schematic illustration showing the general flow of containers which are uncapped when supplied into a capping apparatus of the present invention and which are capped when discharged out of the capping apparatus.

Referring now to FIG. 1, a capping apparatus 1 of the present invention receives containers 3 (see FIG. 2), such as bottles, as supplied from a transporting conveyor 2 via an inlet star wheel 4, and after having been capped within the capping apparatus 1, the containers 3 are discharged to another transporting conveyor 6 through an outlet star wheel 5. The detailed structure of these star wheels may be found in copending U.S. patent application, Ser. No. 06/537,465, which is also assigned to the assignee of this application and which is incorporated herein by reference.

Figure 2:
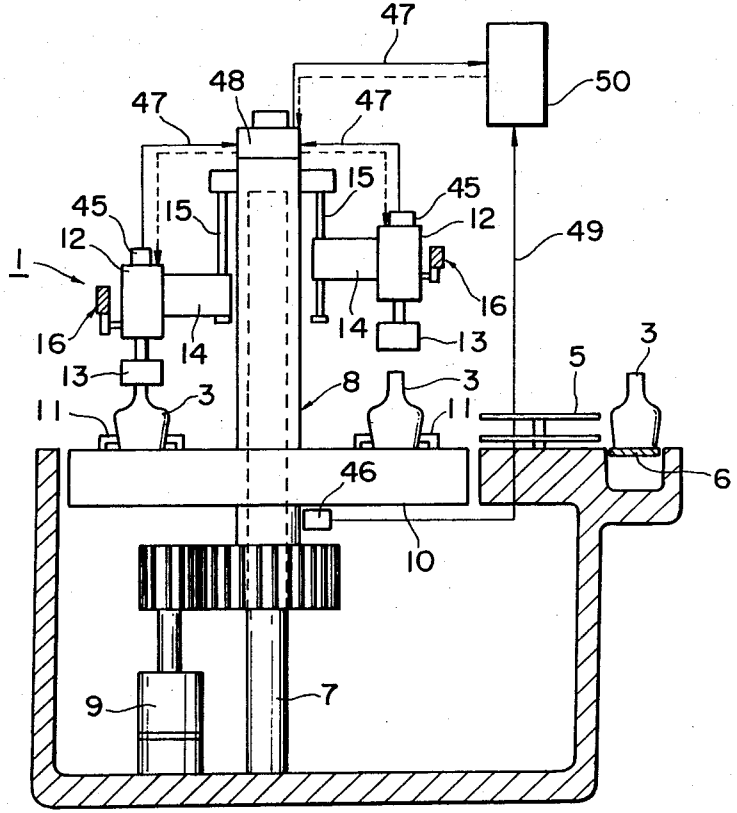
FIG. 2 is a schematic illustration showing partly in cross-section the overall structure of the capping apparatus constructed in accordance with one embodiment of the present invention.

As illustrated in FIG. 2, the capping apparatus includes a fixed shaft 7 which extends vertically from a base of the apparatus, and a rotary cylinder 8 which is rotatably fitted onto the fixed shaft 7 from above. The rotary shaft 8 is operatively coupled to a motor 9, which is fixedly mounted on the base of the apparatus, and, thus, the rotary cylinder 8 may be driven to rotate around the fixed shaft 7 when driven by the motor 9. It is to be noted that although not shown specifically, the motor 9 is driven in a manner which controls the rotational speed of the rotary cylinder 8 in association with the operating speed at other associated stations, such as filling and labelling stations, which are disposed in the same container handling line as the present capping apparatus.

A turn table 10 is provided as fixedly mounted on the rotary cylinder 8, and the turn table 10 is provided with a plurality of container holders 11 as arranged along the periphery thereof at an equally spaced interval. Also provided immediately above and integral with the rotary cylinder is a capping head assembly which includes a plurality of cap holders 13 corresponding in number to the container holders 11 and arranged above in registry in position with and movable closer to or away from the corresponding container holders 11 and torque motors 12 for driving to rotate the corresponding cap holders 13. The torque motors 12 are fixedly mounted on respective brackets 14, which are, in turn, slidably supported on guide rods 15 fixedly mounted on the rotary cylinder 8 and arranged therearound. And, thus, the brackets 14 are moved up and down as guided by the guide rods 15. A cam rail 16 having a predetermined shape is also provided as extending around the rotary cylinder 8 and fixed in position. The brackets 14 are engaged with the cam rail 16 so that the brackets 14 move up and down as guided not only by the guide rods 15 but also by the cam rail 16.

Figure 3:
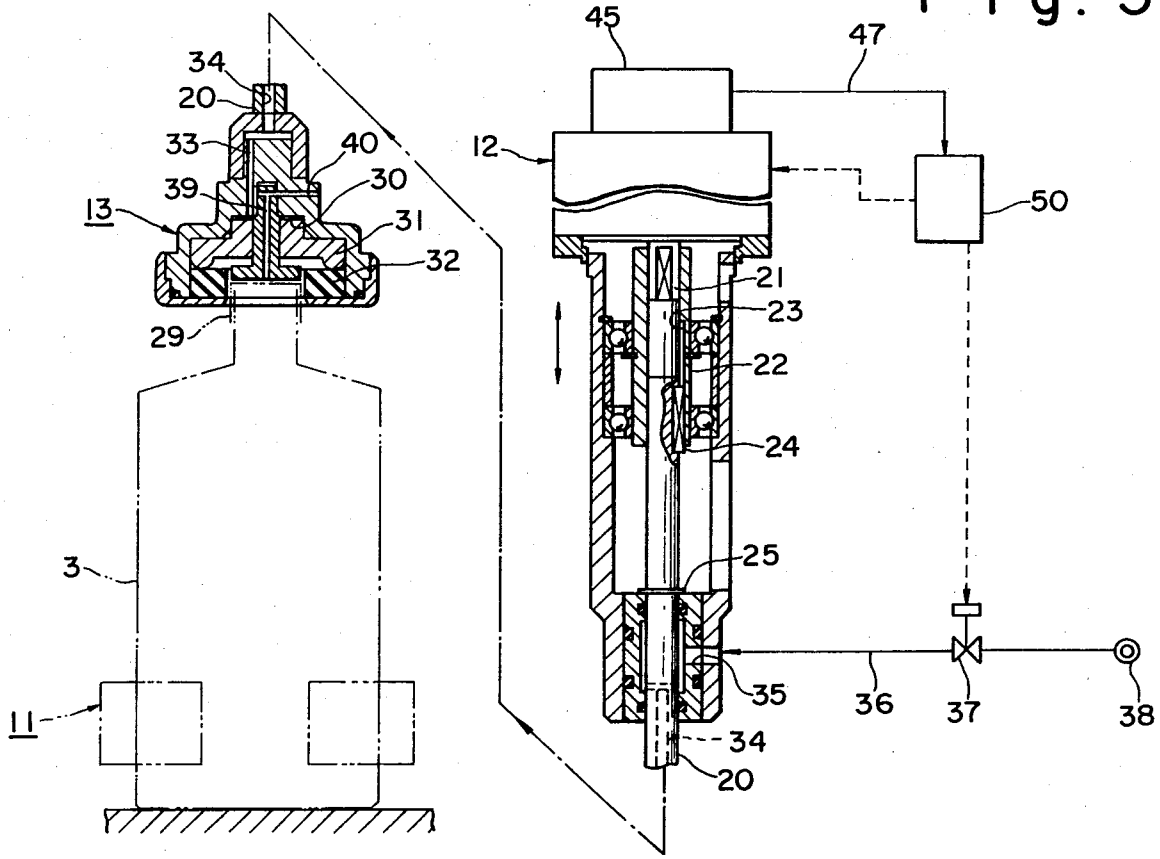
FIG. 3 is a schematic illustration showing the detailed structure of one of the capping heads of the capping apparatus shown in FIG. 2.

As shown in FIG. 3, the cap holder 13 is fixedly attached at the bottom end of a driving shaft 20 which is operatively coupled to a rotary shaft 21 of torque motor 12 through a cylindrical connector 22, which is fixedly mounted on the rotary shaft 21 and which is formed with a longitudinal groove in its inner peripheral surface. At the top end of the driving shaft 20 is provided a key 24 which is loosely fitted into the groove 23. Thus, the driving shaft 20 is in sliding contact with the connector 22 and thus may be moved up and down within a predetermined range with respect to the connector 22 while maintaining a power transmitting relation between the torque motor 12 and the cap holder 13. Also provided is a stopper ring 25 fixedly mounted on the driving shaft 20. The stopper ring 25 determines the lowermost position of the cap holder 13 and prevents the driving shaft 20 from slipping away.

The cap holder 13 is provided to temporarily hold a cap 29 to be tightly screwed onto the mouth of the container 3 which stands upright on the turn table 10 and is held in position by the container holder 11. As shown, the cap holder 13 is provided with a pressure chamber 30 a part of which is defined by a disc 31, which is forced to move downward when a pressurized gas is introduced into the pressure chamber 30. A ring-shaped elastic member 32 is also provided partly in contact with and below the disc 31, and the ring-shaped elastic member 32 has an opening whose diameter is slightly larger than the outer diameter of the cap 29 used. Since the disc 31 is provided with a circular ridge extending along the periphery at its bottom, the ridge is normally in contact with the ring-shaped elastic member 32, which is supported on a closure member provided with a center hole large enough for allowing the cap 29 to extend therethrough. Thus, when the disc 31 is pressed downward, the ring-shaped elastic member 32 deforms thereby making its opening smaller in diameter so that the cap 29 becomes temporarily held by the cap holder 13. The pressure chamber 30 is fluid-dynamically connectable to a pressure gas source 38 through passages 33, 34 and 35, conduit 36 and electromagnetic valve 37. It is to be noted that additional passages 39 and 40 are provided in the cap holder 13 from a point where the top surface of the cap 29 comes to be located when held by the ring-shaped elastic member 32 to the atmosphere, whereby the cap 29 is prevented from being stuck to the cap holder 13 due to creation of vacuum at its top.

The torque motor 12 is provided with a r.p.m. detector 45, such as a rotary encoder, and, as shown in FIG. 2, the capping apparatus includes a position detector 46 for detecting the rotary position of the rotary cylinder 8 mounted on its machine housing. Lead lines 47 from the detectors 45 are connected to a control unit 50, such as a microcomputer, through a rotary joint 48, and a lead line 49 from the other detector 46 is directly connected to the control unit 50. The control unit 50 controls an output of each of the torque motors 12 and thus the level of torque for tightening the cap 29 by the cap holder 13 by adjusting the level of electric current supplied to each of the torque motors 12. And, as will be described later in detail, depending on the rotary position of the rotary cylinder 8, during a first stage of the capping operation, a torque applied to the cap 29 by the cap holder 13 is set at a first level which is larger than a predetermined reference level. During the second stage of the capping operation, the torque is set at a second level which is smaller than the predetermined reference level, followed by a third stage of the capping operation in which the torque is set at the predetermined reference level.

With the above-described structure, when the rotary cylinder 8 is driven to rotate by the motor 9, the containers 3 standing on the transporting conveyor 2 still uncapped are lead into the corresponding container holders 11 on the turn table 10 one by one in sequence as regulated by the inlet star wheel 4 and temporarily secured in position on the turn table 10 standing upright. Meanwhile the caps 29 are supplied from a source (not shown) to be individually held by the cap holders 13 as indicated in FIG. 3. When cap 29 is inserted into the opening defined in the ring-shaped elastic member 32, a detection signal is supplied to the control unit 50 by means of a detector (not shown), and, thus, the control unit 50 supplies an activation signal to the electromagnetic valve 37 to have it energized thereby establishing the open condition. Thus, a gas under pressure is supplied into the pressure chamber 30 from the pressurized gas source 38, so that the ring-shaped elastic member 32 deforms thereby temporarily grabbing the cap 29 securely.

Figure 4:
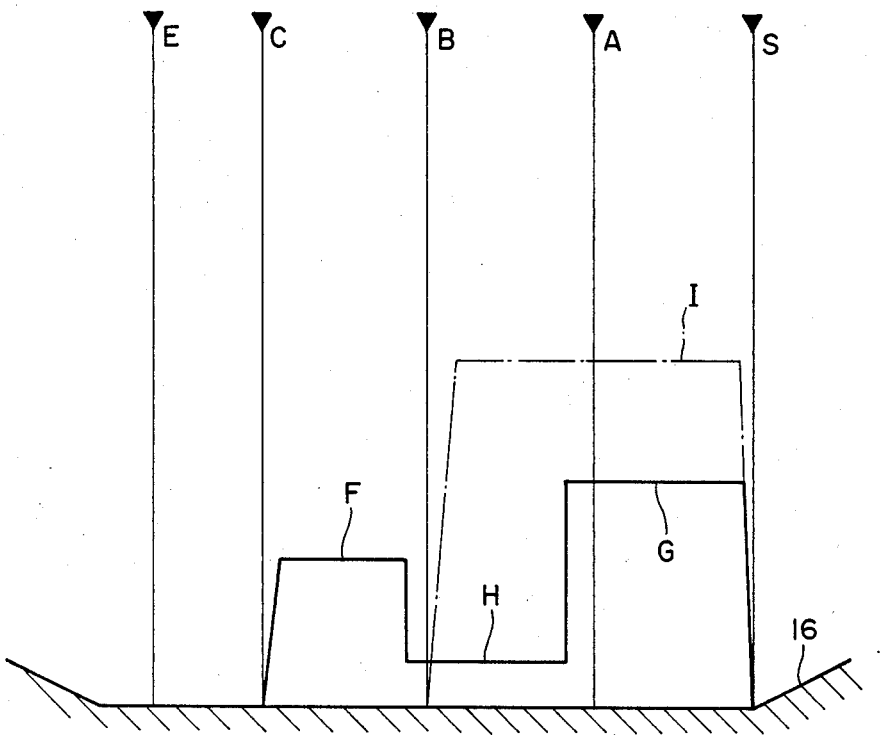
FIG. 4 is a timing chart which is useful for explaining the operation of the present capping apparatus shown in FIGS. 2 and 3.

FIG. 4 shows, from right to left, a progression of steps which occur during a revolution of turn table 10. First, cam rail 16 moves lower to a starting position S, remains low through steps A, B, and C, and rises again after ending position E. Before reaching the starting position S, with the uncapped container 3 securely held by the container holder 11 in position on the turn table 10 and the cap 29 securely held by the cap holder 13, the torque motor 12 and cap holder 13 gradually descend with the rotation of turn table 10 as guided by the cam rail 16 so that the cap 29 now securely held by the cap holder 13 comes to be fitted onto the mouth of the corresponding container 3. The torque motor 12 is maintained inoperative until it is brought to its lower predetermined position. As indicated in FIG. 4, when the detector 46 detects the condition that the rotary position of the rotary cylinder 8 is at a screwing operation initiation position S, i.e., the condition in which the torque motor 12 is located at its lowered position with the cap 29 becoming fitted onto the mouth of the corresponding container 3, the detector supplies a detection signal to the control unit 50, and, thus, the control unit 50 supplies a first driving signal to the torque motor 12 thereby causing it to be driven at a first torque G which is higher in level than a closure torque F having a predetermined reference level.

The reason why the larger torque G is applied at the first stage of capping operation is to prevent the cap 29 from being improperly oriented, or inclined, with respect to the container 3 to be capped. That is, even if the cap 29 is initially inclined with respect to the mouth of the container 3 when brought into engagement by the downward motion of the cap holder 13, it can be properly oriented with respect to the mouth of the container 3 when driven at the larger torque G. The actual level of this larger driving torque G may be set advantageously in consideration of the material and shape of the cap 29.

Position A on FIG. 4 is that position in the rotation of turn table 10 reached when cap 29 has rotated a single revolution. When the cap 29 has rotated a little more than a single revolution from the initial position S, the cap 29 necessarily becomes engaged with a threaded section of the mouth of the container 3, so that the control unit 50 now supplies a second driving signal to the torque motor 12 whereby the torque motor 12 is driven at a second torque H which is lower in level than the closure torque F. Assuming that the cap 29 has been rotated over a predetermined number of revolutions from the initial position S, the screwing operation for having the cap 29 screwed onto the mouth of the container 3 terminates at least at a position prior to position B indicated in FIG. 4 if the thread engagement between the cap 29 and the mouth of the container 3 is normal. At this time, the rotation of the cap 29 ceases as indicated by a one-dotted line I shown in FIG. 4. At this moment, even if an inertia torque due to rotation, which is higher in level than the torque H, is applied to the cap 29, no problem arises in the present invention as long as the final closure torque F is set larger than such an inertia torque.

When the control unit 50 detects the fact that the cap 29 is not in rotation at position B by the detector 45, it supplies a third driving signal to the torque motor 12 so that the torque motor 12 becomes driven to rotate at the final closure torque F. Thus, the cap 29 can be tightly screwed onto the mouth of the container 3 always at the same torque level. Thereafter, when the control unit 50 detects the fact that the rotary cylinder 8 takes a position C indicated in FIG. 4, it causes the torque motor 12 to stop its rotation and to deenergize the electromagnetic valve 37 thereby releasing the cap 29 from the cap holder 13. Then, through the engagement with the cam rail 16, the cap holder 13 and torque motor 12 are returned to their original upper positions. Meanwhile, the container 3 now properly capped with the cap 29 is transferred from the container holder 11 to the transporting conveyor 6 via the outlet star wheel 5.

If the detector 45 detects at position A the condition that the cap holder 13 is not in rotation, the control unit 50 is preferably so structured to supply an alarm signal for activating an alarm device (not shown). Or, alternatively, it may be so structured that the corresponding container 3 when released from the container holder 11 is transported to a predetermined location through an appropriate mechanism for eliminating the container 3 in question from the normal process line.

On the other hand, if the cap holder 13 is detected to be in rotation at position B and also at position C, since this indicates a faulty condition, it is preferably so structured that the control unit 50 supplies an alarm signal or activates the above-described eliminating mechanism. In FIG. 4, a position E indicates the position which is determined to be prior to the position where the cap holder 13 and torque motor 12 return to their original upper positions through engagement with the cam rail 16 after a time period required for releasing the cap 29 by the cap holder 13. If the control operation by the control unit 50 still continues at position E for some reason, such as malfunctioning, its control operation is forcibly terminated thereby causing the cap 29 to be positively released from the cap holder 13. Instead of using the detector 46, there may be provided another detector for exclusively detecting this position E.

In the above-described embodiment, the level of the torque at the torque motor 12 is directly controlled. However, the present invention is also applicable to the previously described sun gear-pinion combination if a multilevel clutch is provided in the power transmitting system between the sun gear and the pinion, in which the clutch adjusts the level of torque to be transmitted by an appropriate means, such as air pressure. In this case, the clutch transfers torques of different levels depending on the level of air pressure supplied thereto.

While the above provides a full and complete disclosure of the present embodiments of the present invention, various modifications, alternate constructions and equivalents may be employed without departing from the true spirit and scope of the invention. Therefore, the above description and illustration should not be construed as limiting the scope of the invention, which is defined by the appended claims.

What is claimed is:

1. Apparatus for capping a container by having a cap screwed onto a mouth portion of said container at a predetermined tightening torque, comprising:

carrier means for carrying thereon said container along a predetermined path;

holding means for releasably holding a cap to be applied to said container, said holding means being movable between an inoperative position where said holding means is located away from said container and an operative position where said holding means is located closer to said container for applying said cap to said container;

torque applying means for applying a torque to said holding means when said holding means is located at said operative position; and control means for controlling the level of said torque applied to said holding means such that during a first stage of capping, said torque has a first level high enough to achieve proper orientation of said cap on said container, during a second stage subsequent to said first stage said torque has a second level which is lower than said predetermined tightening torque, and during a third stage subsequent to said second stage, said torque has said predetermined tightening torque level.

2. The apparatus of claim 1 wherein said second stage is terminated upon completion of screwing said cap onto said mouth portion of said container, and wherein said predetermined tightening torque is higher than a level of an inertia torque which could be applied to said cap upon completion of said screwing.

3. The apparatus of claim 2 wherein said carrier means includes a turn table which is rotatably supported and a plurality of container holders provided along the periphery of said turn table and spaced apart from one another.

* * * * *